US006137229A

United States Patent [19]

Nishiura et al.

[11] Patent Number: 6,137,229

[45] Date of Patent: Oct. 24, 2000

[54] METAL HALIDE LAMP WITH SPECIFIC DIMENSION OF THE DISCHARGE TUBE

[75] Inventors: Yoshiharu Nishiura, Shiga; Kazuo Takeda, Osaka; Hiroshi Nohara, Osaka; Kouichi Sugimoto, Osaka; Shiki Nakayama, Osaka; Takashi Yamamoto, Osaka, all of Japan

[73] Assignee: Matsushita Electronics Corporation, Osaka, Japan

[21] Appl. No.: 09/140,974

[22] Filed: Aug. 27, 1998

[30] Foreign Application Priority Data

Sep. 26, 1997 [JP] Japan ..... 9-261682

[51] Int. Cl.[7] ..... H01J 17/16; H01J 61/30

[52] U.S. Cl. ..... 313/634; 313/550; 313/637

[58] Field of Search ..... 313/634, 550, 313/637

[56] References Cited

U.S. PATENT DOCUMENTS

| | | | |
|---|---|---|---|
| 4,734,612 | 3/1988 | Sasaki et al. | 313/15 |
| 4,749,905 | 6/1988 | Mori et al. . | |
| 5,424,609 | 6/1995 | Geven et al. | 313/623 |

FOREIGN PATENT DOCUMENTS

| | | |
|---|---|---|
| 0 215 524 | 3/1987 | European Pat. Off. . |
| 0 587 238 | 3/1994 | European Pat. Off. . |
| 0 841 687 | 5/1998 | European Pat. Off. . |
| 62-283543 | 12/1987 | Japan . |
| 9-283083 | 10/1997 | Japan . |

*Primary Examiner*—Vip Patel
*Assistant Examiner*—Karabi Guharay
*Attorney, Agent, or Firm*—Merchant & Gould P.C.

[57] ABSTRACT

A metal halide lamp comprises a discharge tube of transparent ceramic in which a discharge metal is sealed, the discharge tube having a main cylindrical portion, ring portions provided at both ends of the main cylindrical portion, and tubular cylindrical portions provided at the ring portions; and a pair of electrodes inside the discharge tube; wherein a wall thickness $\alpha$ (in mm) of the main cylindrical portion satisfies the relation $$0.0023\times W+0.22\leqq\alpha\leqq0.0023\times W+0.62,$$

and a wall thickness $\beta$ (in mm) of the ring portion satisfies the relation $$0.0094\times W+0.5\leqq\beta\leqq0.0094\times W+1.5,$$

wherein W is the lamp power expressed in Watt. Alternatively, the discharge tube is air-tightly enclosed in the outer tube; the outer tube is filled with a gas comprising nitrogen gas; and the wall thickness $\alpha$ (in mm) of the main cylindrical portion satisfies the relation $$0.0023\times W+0.12\leqq\alpha\leqq0.0023\times W+0.62,$$

and the wall thickness $\beta$ (in mm) of the ring portion satisfies the relation $$0.0094\times W+0.3\leqq\beta\leqq0.0094\times W+1.5,$$

wherein W is the lamp power expressed in Watt. Thus, a metal halide lamp can be obtained that has a stable lifetime and considerably increased lamp efficiency compared to conventional high-color-rendition high-performance metal halide lamps using a quartz discharge tube.

2 Claims, 4 Drawing Sheets

METAL HALIDE LAMP WITH SPECIFIC DIMENSION OF THE DISCHARGE TUBE

FIELD OF THE INVENTION

The present invention relates to a metal halide lamp with a ceramic discharge tube.

BACKGROUND OF THE INVENTION

In metal halide lamps comprising a ceramic discharge tube held within an outer tube there is less reactivity between the discharge tube material and enclosed metals compared to quartz discharge tubes, which were in general use before the ascent of ceramic discharge tubes. Therefore, it is expected that a stable lifetime can be obtained for metal halide lamps comprising a ceramic discharge tube.

In the prior art, metal halide lamps having a discharge tube at both end portions of a transparent alumina tube that are closed by insulating ceramic caps or conducting caps are known as such metal halide lamps (see Publication of Unexamined Japanese Patent Publication (Tokkai) No. Sho 62-283543).

Further known are metal halide lamps having a ceramic discharge tube having end portions at both ends of a central portion and having a smaller diameter than the central portion (see Publication of Unexamined Japanese Patent Publication (Tokkai) No. Hei 6-196131). Electrically conductive lead-wires having an electrode at their ends are inserted at both end portions. The gaps between the edge portions of the discharge tube and the conductive lead-wire are sealed with a sealing material Such conventional metal halide lamps using ceramic discharge tubes utilize the high thermal resistance of the ceramic to raise the tube-wall load (lamp power per surface area of the entire discharge tube) compared to metal halide lamps having a quartz discharge tube. It is known that by maintaining a vacuum inside the outer tube, the discharge tube temperature can be raised and the lamp efficiency can be increased. However, there has been no detailed research about the lamp efficiency and lifetime and their relation to the volume of the transparent ceramic constituting the discharge tube.

Because the volume of the transparent ceramic constituting the discharge tube in conventional metal halide lamps having a ceramic discharge tube is large, the proportion of the discharge energy that is thermally lost in the discharge tube is large, so that a considerable increase of the lamp efficiency cannot be achieved.

On the other hand, when the volume of the transparent ceramic constituting the discharge tube is made small to increase the lamp efficiency, the bond strength when the discharge tube is sintered into one piece becomes weak, so that cracks occur during the lamp operation, which lead to leaks in the discharge tube.

Moreover, to realize high efficiency and high color rendition, it is necessary to increase the discharge tube temperature and raise the metal vapor pressure inside the discharge tube. However, when the volume of the transparent ceramic material constituting the discharge tube is too small and a vacuum is maintained inside the outer tube, the discharge tube may be damaged due to heat-cycles during the lamp lifetime, because the discharge tube temperature is too high.

SUMMARY OF THE INVENTION

It is a purpose of the present invention to solve these problems and provide a metal halide lamp with a stable lifetime and considerably increased lamp efficiency.

To achieve the above purposes, the present invention has the following structure:

A metal halide lamp according to a first structure of the present invention comprises a discharge tube of transparent ceramic in which a discharge metal is sealed, the discharge tube having a main cylindrical portion, ring portions provided at both ends of the main cylindrical portion, and tubular cylindrical portions provided at the ring portions; and a pair of electrodes inside the discharge tube; wherein a wall thickness $\alpha$ (in mm) of the main cylindrical portion satisfies the relation $$0.0023\times W+0.22\leqq\alpha\leqq0.0023\times W+0.62,$$

and a wall thickness $\alpha$ (in mm) of the ring portion satisfies the relation $$0.0094\times W+0.5\leqq\beta\leqq0.0094\times W+1.5,$$

wherein W is the lamp power expressed in Watt.

A metal halide lamp according to a second structure of the present invention comprises an outer tube filled with a gas including nitrogen; a discharge tube of transparent ceramic in which a discharge metal is sealed, the discharge tube being air-tightly supported inside the outer tube and the discharge tube having a main cylindrical portion, ring portions provided at both ends of the main cylindrical portion, and tubular cylindrical portions provided at the ring portions; and a pair of electrodes inside the discharge tube; wherein a wall thickness $\alpha$ (in mm) of the main cylindrical portion satisfies the relation $$0.0023\times W+0.12\leqq\alpha\leqq0.0023\times W+0.62,$$

and a wall thickness $\beta$ (in mm) of the ring portion satisfies the relation $$0.0094\times W+0.3\leqq\beta\leqq0.0094\times W+1.5,$$

wherein W is the lamp power expressed in Watt.

According to the above-described first and second structures of the present invention, metal halide lamps can be provided that have a stable lifetime and a lamp efficiency that is increased at least 15% compared to high-color-rendition high-performance metal halide lamps of various wattages using a quartz discharge tube.

DESCRIPTION OF THE PREFERRED EMBODIMENTS

The invention will be better understood from the following detailed description when considered with reference to the accompanying drawings.

First Embodiment

Figure 1:
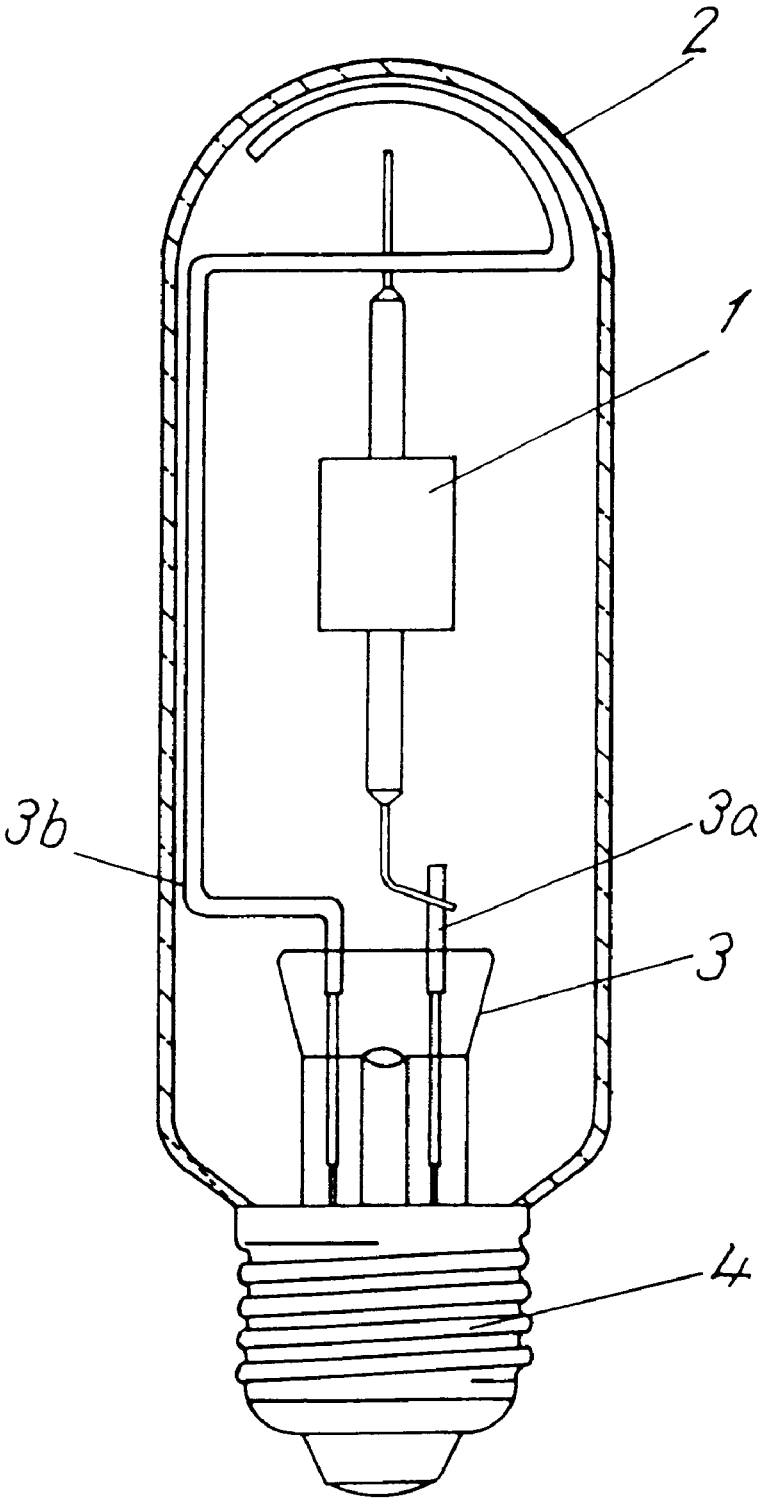
FIG. 1 is a partially cross-sectional front elevation of a metal halide lamp of an embodiment of the present invention.

The 70 W metal halide lamp illustrated in FIG. 1, which is a first embodiment of the present invention, comprises a ceramic discharge tube 1, rigidly supported by metal wires 3*a* and 3*b* inside an outer tube 2. One end of the outer tube 2 is provided with a stem 3, which seals the outer tube 2 air-tight. A vacuum is maintained in the outer tube 2.

A certain amount of mercury, argon as a noble gas for a starting gas, and iodides of dysprosium, thulium, holmium, thallium, and sodium as metal halides are sealed in the discharge tube 1. Numeral 4 indicates a lamp base.

Figure 2:
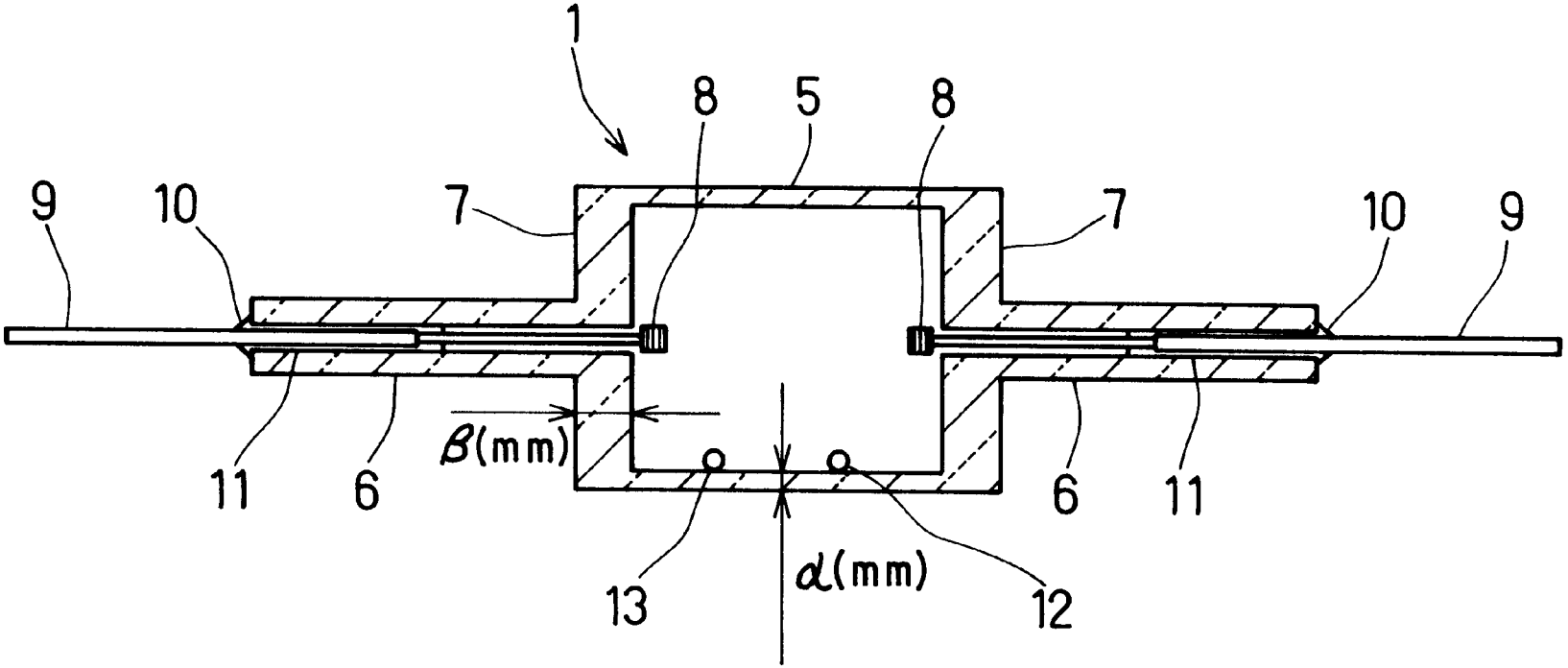
FIG. 2 is a cross-sectional front elevation of the discharge tube of the metal halide lamp of FIG. 1.

As is shown in FIG. 2, the ceramic discharge tube 1 has an outer diameter of 7.8 mm and comprises tubular cylindrical portions 6 of 2.6 mm external diameter and 0.8 mm internal diameter, on both sides of a main cylindrical portion 5 having a wall thickness α (in mm) of 0.6 mm. The main cylindrical portion 5 and the tubular cylindrical portions 6 are sintered into one piece with ring portions 7 having a wall thickness β (in mm) of 1.7 mm.

Lead-in wires 9 made of niobium with a 0.7 mm diameter having an electrode 8 at the tip are inserted into the tubular cylindrical portions 6. The lead-in wires 9 are sealed with a sealing material 10 in the tubular cylindrical portion 6, so that the electrodes 8 are positioned inside the main cylindrical portion 5, and sealing portions 11 are formed in the tubular cylindrical portion 6.

Numeral 12 indicates a mercury pellet and numeral 13 a iodide pellet.

The lamp efficiency was examined for changing wall thickness α (in mm) of the main cylindrical portion 5 and changing wall thickness β (in mm) of the ring portions 7, and the occurrence of leaks in the discharge tube was examined after 100 hours use. Here, occurrence of leaks in the discharge tube means the number of lamps out of a number of eight lamps in which cracks occur in the discharge tube due to the heat cycle of the discharge tube when the lamp is operating, which leads to burn-out of the lamp. The criterion for the lamp efficiency was whether the performance of a conventional high-performance metal halide lamp with high color rendition (at least Ra80) using a quartz discharge tube could be increased at least 15%. This criterion is 90 lm/W for a 70W metal halide lamp.

Table 1 shows the results of these measurements.

TABLE 1

| α (in mm) | β (in mm) | Lamp Efficiency (lm/W) | Occurrence of Leaks in the Discharge Tube | Evaluation |
|---|---|---|---|---|
| 0.3 | 1.2 | 106 | 4/8 | x |
| 0.3 | 1.7 | 104 | 3/8 | x |
| 0.3 | 2.2 | 102 | 1/8 | x |
| 0.4 | 1.0 | 104 | 1/8 | x |
| 0.4 | 1.2 | 102 | 0/8 | ○ |
| 0.4 | 1.7 | 98 | 0/8 | ○ |
| 0.4 | 2.2 | 95 | 0/8 | ○ |
| 0.4 | 2.6 | 89 | 0/8 | x |
| 0.5 | 1.7 | 95 | 0/8 | ○ |
| 0.6 | 1.7 | 94 | 0/8 | ○ |
| 0.7 | 1.7 | 93 | 0/8 | ○ |
| 0.8 | 1.7 | 92 | 0/8 | ○ |
| 0.8 | 2.2 | 90 | 0/8 | ○ |
| 0.9 | 2.2 | 89 | 0/8 | x |
| 0.9 | 2.6 | 87 | 0/8 | x |

The tube-wall load was held constant at 30 W/cm$^2$.

As becomes clear from Table 1, it could be confirmed that when the wall thickness α (in mm) of the main cylindrical portion 5 was not more than 0.8 mm and the wall thickness β (in mm) of the ring portions 7 was not more than 2.2 mm, a lamp efficiency of at least 90 lm/W could be realized.

Furthermore, it could be confirmed that when the wall thickness α (in mm) of the main cylindrical portion 5 was less than 0.4 mm or the wall thickness β (in mm) of the ring portions 7 was less than 1.2 mm, leaks occurred in the discharge tube during a lamp operation of 100 hours.

Accordingly, the lamps marked with a circle (○) in the "Evaluation" column of Table 1 are 70 W metal halide lamps with a stable lifetime and considerably increased lamp efficiency.

This means that a 70 W metal halide lamp with considerably increased lamp efficiency and stable lifetime can be obtained, when the wall thickness α (in mm) of the main cylindrical portion 5 is 0.4 mm to 0.8 mm and the wall thickness β (in mm) of the ring portions 7 is 1.2 to 2.2 mm as in the lamp of the present invention.

Moreover, the same examination was performed for 35 W, 100 W, 150 W, and 250 W lamps, to establish a relation between the wall thickness α (in mm) of the main cylindrical portion 5 and the wall thickness β (in mm) of the ring portions 7 for which the lamp has a stable lifetime and the lamp efficiency can be increased at least 15% compared to a high-color-rendition high-performance metal halide lamp using a quartz discharge tube. The results are shown in FIGS. 3 and 4.

Figure 3:
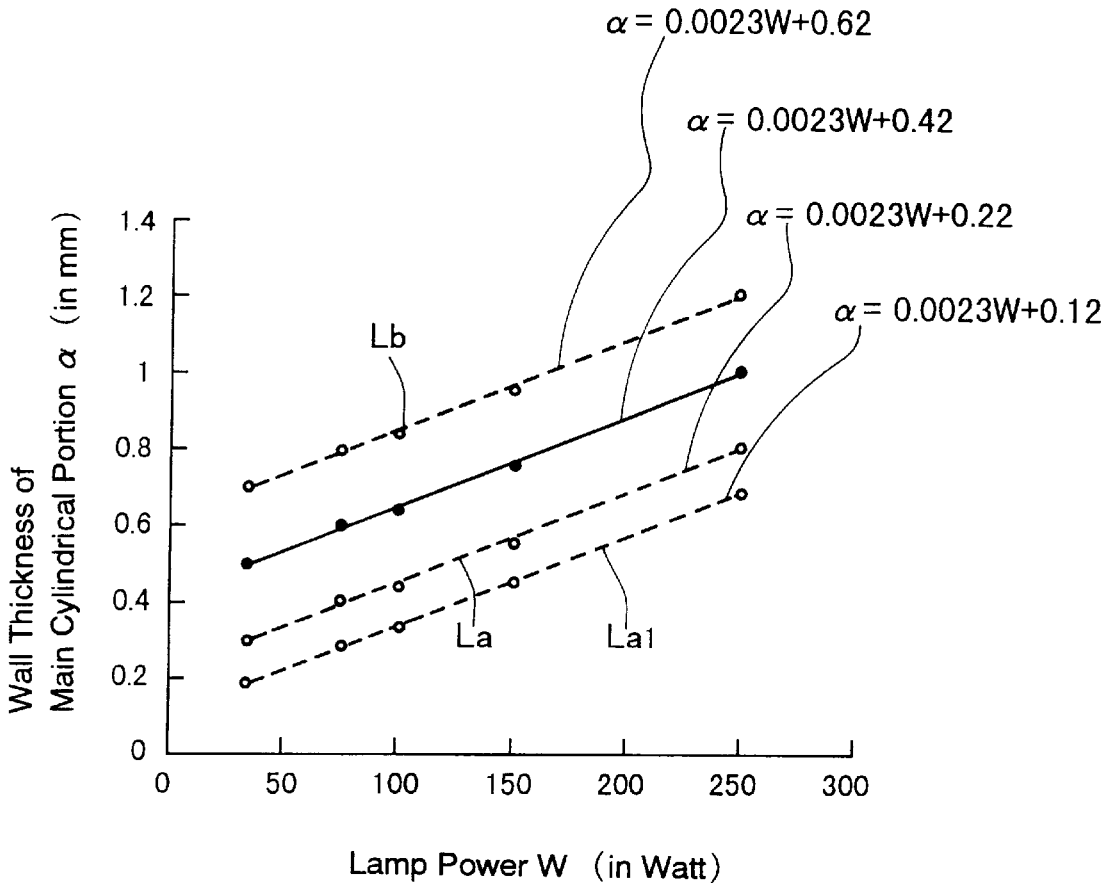
FIG. 3 is a graph showing the wall thickness of the main cylindrical portions as functions of the lamp power.
Figure 4:
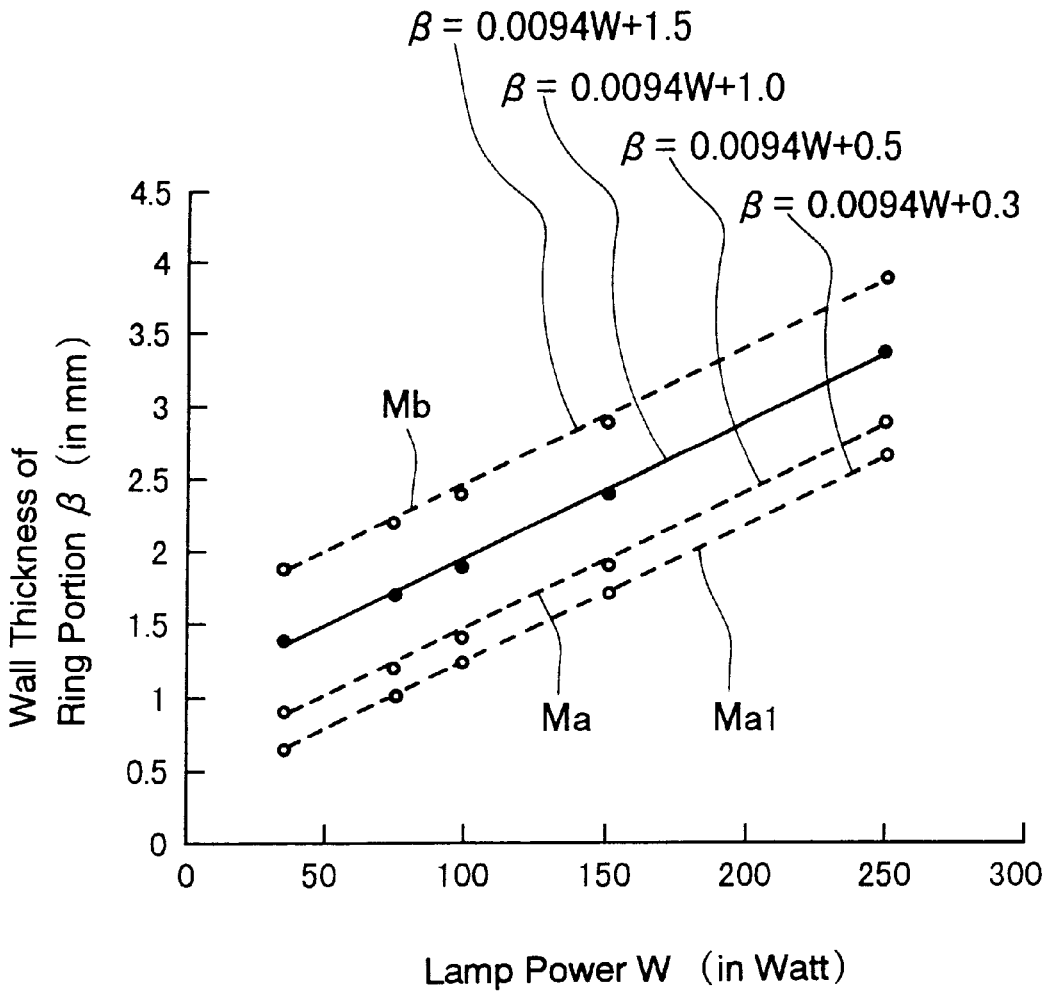
FIG. 4 is a graph showing the wall thickness of the ring portions as functions of the lamp power.

Each of the different lamps had a stable lifetime with a lamp efficiency that was increased at least 15% compared to a high-color-rendition high-performance metal halide lamp using a quartz discharge tube when the wall thickness α (in mm) of the main cylindrical portion 5 was in the range between the straight lines La and Lb as indicated in FIG. 3. In a range below the straight line La, leaks occurred in the discharge tube during a lamp operation of 100 hours. In a range above the straight line Lb, the lamp efficiency did not improve at least 15% compared to conventional metal halide lamps using a quartz discharge tube.

When the wall thickness β (in mm) of the ring portions 7 in FIG. 4 was in a range below the straight line Ma, leaks occurred in the discharge tube during a lamp operation of 100 hours. In a range above the straight line Mb, the lamp efficiency did not improve at least 15%.

This means that a metal halide lamp that has a stable lifetime with a lamp efficiency that is increased at least 15% compared to a high-color-rendition high-performance metal halide lamp using a quartz discharge tube can be obtained, when the wall thickness α (in mm) is in the range of $$0.0023\times W+0.22 \leqq \alpha \leqq 0.0023\times W+0.62$$

and the wall thickness β (in mm) of the ring portions 7 is in the range of $$0.0094\times W+0.5 \leqq \beta \leqq 0.0094\times W+1.5,$$

wherein W is the lamp power in Watt.

Second Embodiment

The 70 W metal halide lamp according to a second embodiment of the present invention, comprises a ceramic discharge tube 1, rigidly supported by metal wires 3*a* and 3*b* inside an outer tube 2, as illustrated in FIG. 1.

One end of the outer tube 2 is provided with a stem 3, which seals the outer tube 2 air-tight. The outer tube 2 is filled with nitrogen under a pressure of 350 Torr.

A certain amount of mercury, argon as a noble gas for a starting gas, and iodides of dysprosium, thulium, holmium, thallium, and sodium as metal halides are sealed in the discharge tube 1. Numeral 4 indicates a lamp base.

As is shown in FIG. 2, the ceramic discharge tube 1 has an outer diameter of 7.6 mm and comprises tubular cylindrical portions 6 of 2.6 mm external diameter and 0.8 mm internal diameter, on both sides of a main cylindrical portion 5 with a wall thickness α (in mm) of 0.5 mm. The main cylindrical portion 5 and the tubular cylindrical portions 6 are sintered into one piece with ring portions 7 with a wall thickness β (in mm) of 1.5 mm. The other structure is same as in the first embodiment.

The lamp efficiency was examined for a changing wall thickness α (in mm) of the main cylindrical portion 5 and a changing wall thickness β (in mm) of the ring portions 7, and the occurrence of leaks in the discharge tube was examined after 100 hours use.

Table 2 shows the results of these measurements.

TABLE 2

| α (in mm) | β (in mm) | Lamp Efficiency (lm/W) | Occurrence of Leaks in the Discharge Tube | Evaluation |
|---|---|---|---|---|
| 0.2 | 1.0 | 110 | 5/8 | x |
| 0.2 | 1.2 | 108 | 4/8 | x |
| 0.2 | 1.7 | 106 | 4/8 | x |
| 0.2 | 2.2 | 104 | 3/8 | x |
| 0.3 | 0.8 | 110 | 2/8 | x |
| 0.3 | 1.0 | 108 | 0/8 | ○ |
| 0.3 | 1.2 | 106 | 0/8 | ○ |
| 0.3 | 1.7 | 104 | 0/8 | ○ |
| 0.3 | 2.2 | 102 | 0/8 | ○ |
| 0.4 | 1.0 | 104 | 0/8 | ○ |
| 0.4 | 1.2 | 102 | 0/8 | ○ |
| 0.4 | 1.7 | 98 | 0/8 | ○ |
| 0.4 | 2.2 | 95 | 0/8 | ○ |
| 0.4 | 2.6 | 89 | 0/8 | x |
| 0.5 | 1.7 | 95 | 0/8 | ○ |
| 0.6 | 1.7 | 94 | 0/8 | ○ |
| 0.7 | 1.7 | 93 | 0/8 | ○ |
| 0.8 | 1.7 | 92 | 0/8 | ○ |
| 0.8 | 2.2 | 90 | 0/8 | ○ |
| 0.9 | 2.2 | 89 | 0/8 | x |
| 0.9 | 2.6 | 87 | 0/8 | x |

Accordingly, the lamps marked with a circle (○) in the "Evaluation" column of Table 2 are lamps with a stable lifetime and a lamp efficiency that is increased at least 15% compared to conventional metal halide lamps using a quartz discharge tube.

As becomes clear from Table 2, it could be confirmed that when the wall thickness α (in mm) of the main cylindrical portion 5 was less than 0.3 mm or the wall thickness β (in mm) of the ring portions 7 was less than 1.0 mm, leaks occurred in the discharge tube during a lamp operation of 100 hours. The outer tube 2 of the 70 W lamp according to the second embodiment of the present invention is filled with nitrogen gas, so that a convection current arises in the outer tube. Due to this convection current, the temperature of the ceramic discharge tube is lowered, so that leaks in the discharge tube do not occur, even when the wall thicknesses of the main cylindrical portion 5 and the ring portions 7 are thinner than in an outer tube with a vacuum.

Deterioration of the lamp efficiency does not occur due to the very high vapor pressure of the metal halides in the discharge tube and the lower temperature of the discharge tube.

This means that a 70 W metal halide lamp, the outer tube of which is filled with nitrogen, having considerably increased lamp efficiency and stable lifetime, can be obtained when the wall thickness α (in mm) of the main cylindrical portion 5 is 0.3 to 0.8 mm and the wall thickness β (in mm) of the ring portions 7 is 1.0 to 2.2 mm as in the lamp of the present invention.

Moreover, the same examination was performed for 35 W, 100 W, 150 W, and 250 W lamps, to establish a relation between the wall thickness α (in mm) of the main cylindrical portion 5 and the wall thickness β (in mm) of the ring portions 7 for which the lamp has a stable lifetime and the lamp efficiency can be increased at least 15% compared to a high-color-rendition high-performance metal halide lamp using a quartz discharge tube. The results are shown in FIGS. 3 and 4.

Each of the different lamps had a stable lifetime with a lamp efficiency that was increased at least 15% compared to a high-color-rendition high-performance metal halide lamp using a quartz discharge tube when the wall thickness α (in mm) of the main cylindrical portion 5 was in the range between the straight lines La1 and Lb as indicated in FIG. 3. In a range below the straight line La1, leaks occurred in the discharge tube during a lamp operation of 100 hours. In a range above the straight line Lb, the lamp efficiency did not improve at least 15% compared to conventional metal halide lamps using a quartz discharge tube.

When the wall thickness β (in mm) of the ring portions 7 in FIG. 4 was in a range below the straight line Ma1, leaks occurred in the discharge tube during a lamp operation of 100 hours. In a range above the straight line Mb, the lamp efficiency did not improve at least 15%.

This means that a metal halide lamp that has a stable lifetime with a lamp efficiency that is increased at least 15% compared to a high-color-rendition high-performance metal halide lamp using a quartz discharge tube can be obtained when the wall thickness α (in mm) is in the range of $$0.0023\times W+0.12\leqq\alpha\leqq0.0023\times W+0.62$$

and the wall thickness β (in mm) of the ring portions 7 is in the range of $$0.0094\times W+0.3\leqq\beta\leqq0.0094\times W+1.5,$$

wherein W is the lamp power in Watt.

In the above-described first and second embodiments, niobium wires were used for the lead-in wires in the sealed portion. However, instead of niobium, other materials with a thermal expansion coefficient that is close to the thermal expansion coefficient of the discharge tube material can be used for the lead-in wires. Moreover, conductive or non-conductive ceramic caps can be used for the sealing portion. Furthermore, a discharge tube can be used where the main cylindrical portion, the tubular cylindrical portions and the ring portions are molded in one piece.

Furthermore, in the second embodiment of the present invention, the outer tube 2 was filled with nitrogen gas, but it can also be filled with a gas mixture containing nitrogen. An example for a gas that can be mixed with nitrogen and then filled into the outer tube 2 is neon (Ne). If a gas mixture containing nitrogen is used, it is preferable that the nitrogen gas accounts for at least 50 vol % of the gas mixture.

In the present invention, there is no particular limitation concerning the ceramic material used for the discharge tube. For example, single-crystal metallic oxides such as sapphire, polycrystal metallic oxides such as alumina ($Al_2O_3$), yttrium—aluminium—garnet (YAG), and yttriumoxide (YOX) or polycrystal nonoxides such as aluminium nitrides (AlX) can be used for the discharge tube.

Moreover, hard glass has been used for the outer tube in the first and the second embodiment. However, there is no particular limitation concerning the outer tube in the present invention, and any known material for such outer tubes can be used.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal halide lamp comprising a discharge tube of transparent ceramic in which a discharge metal is sealed, said discharge tube having a main cylindrical portion, ring portions provided at both ends of the main cylindrical portion, and tubular cylindrical portions provided at the ring portions; and a pair of electrodes inside the discharge tube;

wherein a wall thickness $\alpha$ (in mm) of said main cylindrical portion satisfies the relation $$0.0023\times W+0.22\leqq\alpha\leqq0.0023\times W+0.62,$$

and a wall thickness $\beta$ (in mm) of the ring portions satisfies the relation $$0.0094\times W+0.5\leqq\beta\leqq0.0094\times W+1.5,$$

wherein W is the lamp power expressed in Watt.

2. A metal halide lamp comprising an outer tube filled with a gas comprising nitrogen;

a discharge tube of transparent ceramic in which a discharge metal is sealed, said discharge tube being airtightly supported inside said outer tube and said discharge tube having a main cylindrical portion, ring portions provided at both ends of the main cylindrical portion, and tubular cylindrical portions provided at the ring portions; and a pair of electrodes inside the discharge tube;

wherein a wall thickness $\alpha$ (in mm) of said main cylindrical portion satisfies the relation $$0.0023\times W+0.12\leqq\alpha\leqq0.0023\times W+0.62,$$

and a wall thickness $\beta$ (in mm) of the ring portion satisfies the relation $$0.0094\times W+0.3\leqq\beta\leqq0.0094\times W+1.5,$$

wherein W is the lamp power expressed in Watt.

* * * * *